US008678210B1

(12) United States Patent
Harrington et al.

(10) Patent No.: US 8,678,210 B1
(45) Date of Patent: Mar. 25, 2014

(54) TELESCOPING BOOM ASSEMBLY WITH BASE SECTION HAVING PRIMARY SHELL AND SECONDARY FORMED SHELL

(75) Inventors: Daniel L. Harrington, Lexington, KY (US); John P. Jones, Nicholasville, KY (US)

(73) Assignee: Link-Belt Construction Equipment Co., L.P., LLLP, Lexington, KY (US)

( * ) Notice: Subject to any disclaimer, the term of this patent is extended or adjusted under 35 U.S.C. 154(b) by 501 days.

(21) Appl. No.: 12/947,946

(22) Filed: Nov. 17, 2010

(51) Int. Cl.
*B66C 23/00* (2006.01)

(52) U.S. Cl.
USPC ..... 212/347; 212/177

(58) Field of Classification Search
USPC ..... 212/347, 348, 350, 177, 270
See application file for complete search history.

(56) References Cited

U.S. PATENT DOCUMENTS

| | | | | |
|---|---|---|---|---|
| 2,949,692 | A | 8/1960 | Kuhn | |
| 2,975,910 | A * | 3/1961 | Conrad | 212/300 |
| 3,112,035 | A * | 11/1963 | Knight | 212/231 |
| 3,315,821 | A | 4/1967 | Grove | |
| 3,371,801 | A * | 3/1968 | Widegren | 212/348 |
| 3,423,890 | A | 1/1969 | Leigh | |
| 3,587,886 | A * | 6/1971 | Gano et al. | 414/718 |
| 3,708,937 | A | 1/1973 | Sterner | |
| 3,719,403 | A * | 3/1973 | Sung | 384/35 |
| 3,807,108 | A | 4/1974 | Johnston | |
| 3,884,359 | A * | 5/1975 | Suverkrop | 212/289 |
| 3,890,757 | A * | 6/1975 | Lamer et al. | 52/695 |
| 3,944,082 | A * | 3/1976 | Fritsch | 212/347 |
| 3,947,191 | A * | 3/1976 | Milner, Jr. | 403/334 |
| 3,958,377 | A * | 5/1976 | Milner, Jr. | 52/118 |
| 3,987,594 | A * | 10/1976 | Rao et al. | 52/111 |
| 4,003,168 | A * | 1/1977 | Brady | 52/118 |
| 4,016,688 | A * | 4/1977 | Tiffin et al. | 52/118 |
| 4,155,464 | A * | 5/1979 | Hogg | 212/300 |
| 4,222,492 | A * | 9/1980 | Wuerflein et al. | 212/270 |
| 4,290,731 | A * | 9/1981 | Griffith | 414/678 |
| 4,318,488 | A * | 3/1982 | Rathi | 212/270 |
| 4,337,601 | A * | 7/1982 | Vaerk et al. | 52/118 |
| 4,385,704 | A * | 5/1983 | Spain et al. | 212/350 |
| 5,431,526 | A * | 7/1995 | Peterson et al. | 414/543 |
| 6,086,256 | A * | 7/2000 | Paschke et al. | 384/35 |
| 6,478,528 | B1 * | 11/2002 | Asbury | 414/550 |
| 6,499,612 | B1 * | 12/2002 | Harrgington et al. | 212/350 |
| 6,516,962 | B1 * | 2/2003 | Irsch et al. | 212/348 |
| 7,878,346 | B1 * | 2/2011 | Watts et al. | 212/168 |
| 8,074,359 | B2 * | 12/2011 | Bong | 29/897.3 |
| 2005/0161422 | A1 * | 7/2005 | Boily | 212/177 |
| 2006/0207215 | A1 * | 9/2006 | Bruno | 52/745.12 |
| 2007/0071587 | A1 * | 3/2007 | Baumann et al. | 414/680 |
| 2007/0175174 | A1 * | 8/2007 | Bruno | 52/745.12 |
| 2008/0169258 | A1 * | 7/2008 | Weisbauer | 212/296 |
| 2010/0282700 | A1 * | 11/2010 | Richter | 212/177 |

FOREIGN PATENT DOCUMENTS

| | | | | |
|---|---|---|---|---|
| WO | WO 2005092775 | A1 * | 10/2005 | B66C 23/42 |

* cited by examiner

*Primary Examiner* — Emmanuel M Marcelo
*Assistant Examiner* — Michael Gallion
(74) *Attorney, Agent, or Firm* — King & Schickli, PLLC

(57) ABSTRACT

A mobile crane includes a boom extension assembly having a base boom section with a primary shell and a secondary formed shell attached thereto, which allows for selective strengthening along the length of the base boom section. Methods involve manufacturing a boom assembly including such a base boom section.

17 Claims, 8 Drawing Sheets

TELESCOPING BOOM ASSEMBLY WITH BASE SECTION HAVING PRIMARY SHELL AND SECONDARY FORMED SHELL

TECHNICAL FIELD

The present invention relates generally to cranes and, more particularly to a telescoping boom assembly including a base section having a primary shell and a secondary formed shell attached thereto.

BACKGROUND OF THE INVENTION

Various types of boom assemblies for use in cranes or other lifting devices are known in the art. Generally, conventional mobile cranes have an extendable boom assembly including base section carrying a plurality of telescoping boom sections. As should be appreciated, the base section must be designed to carry the full weight of the boom when fully extended, plus any corresponding load being lifted.

While the solution to increasing boom strength would seem to dictate simply adding to the thickness of the shell forming the base section, this competes with the goal of lowering the weight of the boom as much as possible, not only for purposes of lifting power constraints, but also for over-the-road travel (for which there are typically stringent weight restrictions to avoid damage to the roadway). Adding thickness to the material forming the shell also greatly complicates the manufacturing process, since the boom is typically a rounded structure requiring difficult and costly metalworking processes, such as breaking and welding. Moreover, welding a "doubler" directly to the rounded underside of the primary shell to increase the overall thickness of the boom typically causes undesirable deformation in the underlying material.

Accordingly, there is a need for a mobile crane having a telescoping boom that is capable of achieving a more desirable balance between added strength and reduced weight, without unduly complicating the manufacturing process or increasing the resulting cost.

SUMMARY OF THE INVENTION

In one aspect, the disclosure relates to a mobile crane for intended use in lifting an object. The crane comprises a chassis including a plurality of ground-engaging structures (for support or travel), a lifter carried by the chassis for use in lifting the object, and a telescoping boom assembly carried by the chassis. The telescoping boom assembly includes a base boom section extending in a longitudinal direction and at least one telescoping boom section nested at least partially within the base boom section. The base boom section includes a primary shell having a first end with an opening for receiving the at least one telescoping boom section, a second end opposite the first end, and an intermediate portion corresponding to a connection point for connecting the lifter to the telescoping boom assembly. The base boom section further includes a secondary shell connected to an external surface of the primary shell. The secondary shell extends from adjacent the connection point to adjacent the first end of the primary shell, and forms a gap between an inner surface of the secondary shell and the underlying external surface of the primary shell of the base boom section.

In one embodiment, the secondary shell is generally U-shaped in cross-section. Preferably, the shell is generally tapered in the longitudinal direction. In such case, the gap may be greater adjacent the connection point than adjacent the first end of the primary shell.

The secondary shell may also include ribs extending between the outer surface of the primary shell and the inner surface of the secondary shell. These ribs may extend in the longitudinal direction or a direction transverse to the longitudinal direction. Most preferably, the ribs comprise plates welded to the primary shell and the secondary shell.

Welds may be provided for welding the secondary shell to the primary shell. Preferably, the primary shell comprises a bottom wall, a top wall, and sidewalls therebetween. At least a portion of the welds are most preferably provided between the secondary shell and at least one of the sidewalls of the primary shell. Still more preferably, the primary shell includes a neutral axis, and the welds are positioned on opposing sides of the primary shell and generally parallel with the neutral axis.

The secondary shell may also include the connector for connecting to the lifter to the telescoping boom assembly. Preferably, a portion of the secondary shell has a thickness less than or equal to a thickness of a portion of the primary shell covered by the secondary shell.

Another aspect of the disclosure relates to a mobile crane for intended use in lifting an object. The mobile crane includes a chassis including a plurality of ground-engaging structures, a lifter carried by the chassis for use in lifting the object, and a telescoping boom assembly carried by the chassis. The boom assembly includes a base boom section extending in a longitudinal direction and at least one telescoping boom section nested in the base boom section, which includes a primary shell including a bottom wall, a top wall, and sidewalls. The walls together define a first end having an opening for receiving the telescoping boom section, a second end opposite the first end, and an intermediate portion therebetween. The base boom section further includes a secondary shell connected to the sidewalls of the primary shell in at least the longitudinal direction by welds and forming a gap between the inner surface of the secondary shell and an outer surface of the primary shell.

Preferably, the welds provided in the longitudinal direction along the sidewalls are in vertical alignment with a neutral axis of the base boom section. The secondary shell may also include the connector for connecting to the lifter to the telescoping boom assembly. The secondary shell preferably extends from the intermediate portion at a connection point for the lifter to the first end of the primary shell.

Yet another aspect of the disclosure relates to a boom assembly for use in a mobile crane for lifting objects using a lifter. The boom assembly includes a base boom section extending in a longitudinal direction and at least one telescoping boom section nested in the base boom section. The base boom section includes a primary shell including a first end having an opening for receiving the telescoping boom section, a second end opposite the first end, and an intermediate portion corresponding to a connection point for the lifter. A secondary shell is connected to an external surface of the primary shell. The secondary shell extends from adjacent the connection point to adjacent the first end of the primary shell, and forms a gap between an inner surface of the secondary shell and the underlying external surface of the primary shell of the base boom section.

A further aspect of the disclosure is a boom assembly for use in a mobile crane for lifting objects using a lifter. The boom assembly comprises a base boom section extending in a longitudinal direction and at least one telescoping boom section nested in the base boom section. The base boom section includes a primary shell including a first end having an opening for receiving the telescoping boom section, a second end opposite the first end, and an intermediate portion corresponding to a connection point for the lifter. The base boom section further includes a secondary shell connected to the sidewalls of the primary shell by welds and forming a gap between the inner surface of the secondary shell and an outer surface of the primary shell.

Yet another aspect of the disclosure relates to a boom assembly for use in a mobile crane for lifting objects using a lifter. The boom assembly comprises a base boom section extending in a longitudinal direction and adapted for receiving at least one telescoping boom section nested in the base boom section, said base boom section including a top wall, a bottom wall, and a pair of sidewalls therebetween. The walls form a first end having an opening for receiving the telescoping boom section, a second end opposite the first end, and an intermediate portion corresponding to a connection point for the lifter. The height of the base boom section in a vertical direction changes from a first dimension adjacent the first end, to a second dimension larger than the first dimension adjacent the connection point, to a third dimension smaller than the first dimension adjacent the second end.

To create such a boom, the bottom wall may taper gradually in the vertical direction from adjacent the first end to adjacent the second end of the base boom section. Preferably, the base boom section comprises a primary shell and a secondary shell connected thereto and forming the bottom wall of the base boom section.

Still another aspect of the disclosure is a method for manufacturing a boom assembly arranged for lifting an object using a lifter. The method comprises providing a base boom section extending in a longitudinal direction and at least one telescoping boom section nested in the base boom section. The base boom section includes a primary shell including a first end having an opening for receiving the telescoping boom section, a second end opposite the first end, and an intermediate portion corresponding to a connection point for connecting the lifter. The method further includes welding a secondary shell to an external surface of the primary shell between the connection point and the first end, said shell forming a gap between the inner surface of the secondary shell and an outer surface of the primary shell.

In one embodiment, the method comprises welding the secondary shell to the base boom using welds in the longitudinal direction in vertical alignment with the neutral axis. The method may further include the step of at least partially tapering the secondary shell relative to the primary shell in the longitudinal direction. Still further, the method may include the step of providing the secondary shell with a connector for connecting the lifter to the secondary shell.

As an added aspect of the disclosure, a method for manufacturing a boom assembly arranged for lifting an object using a lifter is provided. The method comprises providing a base boom section having a first vertical dimension adjacent to a first end, a second vertical dimension greater than the first dimension adjacent to a connection point for connecting the lifter to the boom assembly, and a third vertical dimension less than the first vertical dimension adjacent to a second end of the base boom section. Preferably, the providing step comprises tapering the bottom wall of the boom in the vertical direction between the first end and the connection point.

Still other aspects of the present invention will become apparent to those skilled in the art from the following description wherein there is shown and described a preferred embodiment of this invention, simply by way of illustration of one of the modes best suited to carry out the invention. As it will be realized, the invention is capable of other different embodiments and its several details are capable of modification in various aspects, all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles of the disclosed embodiments of the invention.

In the drawings.

DETAILED DESCRIPTION OF THE PREFERRED EMBODIMENT

Figure 1:
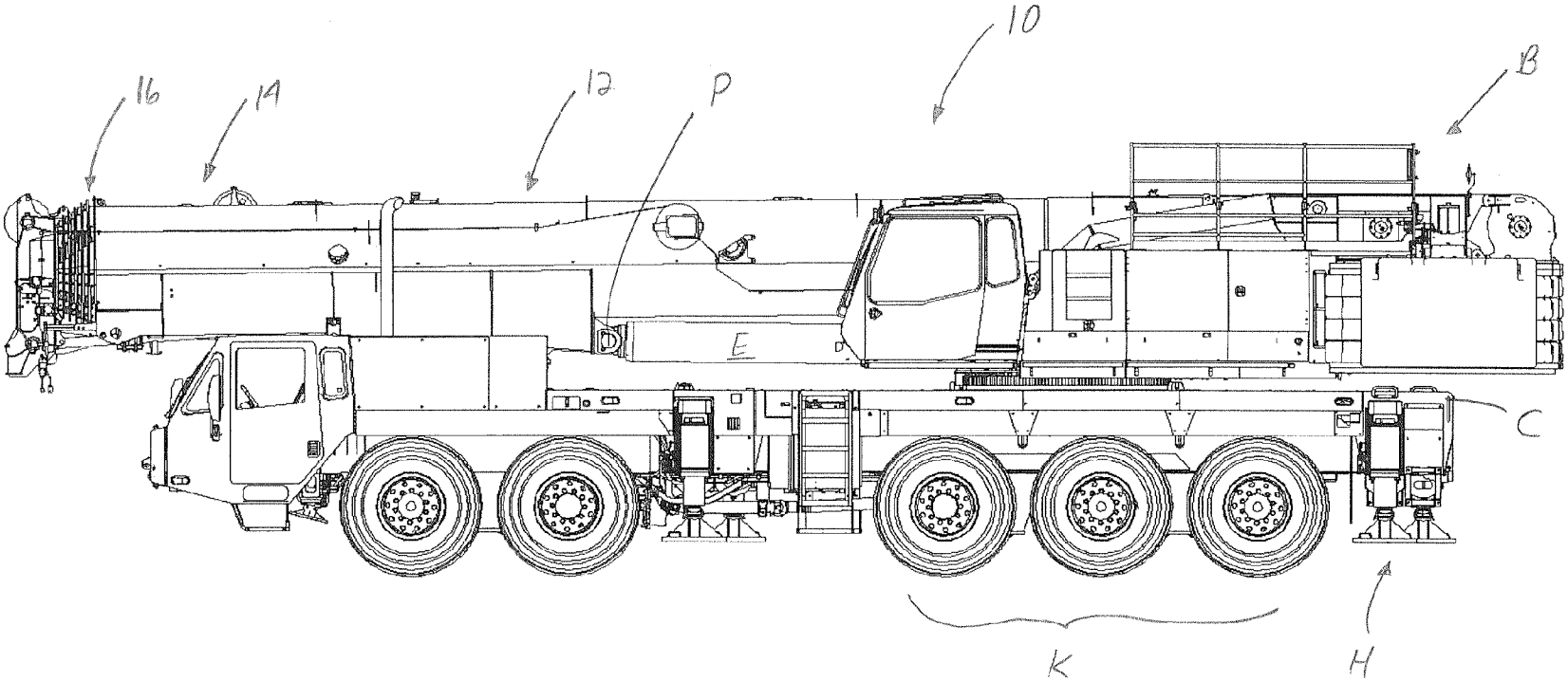
FIG. 1 is a perspective view of a mobile crane.

Reference is now made to FIG. 1, which provides an overall perspective view of a mobile crane 10 for which the inventions described herein may have utility. In the embodiment illustrated in FIG. 1, this crane 10 includes a telescoping boom assembly 12 having at least two generally tubular boom sections 14, 16. The first or outer base boom section 14 is pivotally mounted on a bodily rotatable base B supported by a chassis C having ground-engaging structures (e.g., wheels K or crawler tracks and outriggers H), while the second boom section 16 is telescopically received within the first or base boom section 14. It should be appreciated that additional boom sections may be telescopically received within the second boom section 14 and so on. An internal hydraulic cylinder (not shown) is provided to move the telescoping boom sections 14, 16 relative to each other in a manner known in the art, and a lifter E, such as an external cylinder, connects with the boom assembly 12 at a connection point P, and can be used to pivot it in a vertical direction in a selective fashion to lift objects.

Figure 2:
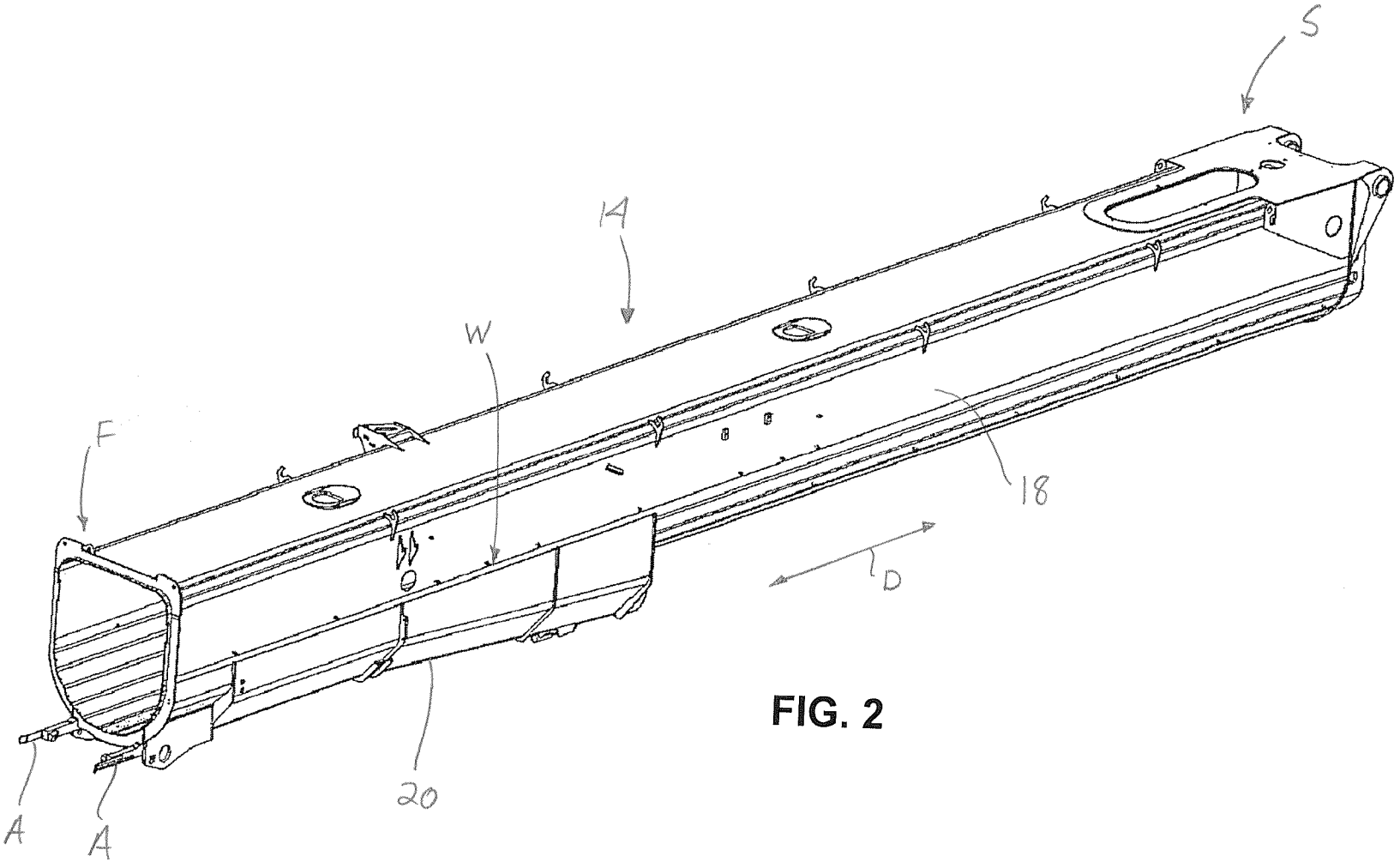
FIG. 2 is a perspective view of a boom base section including a primary shell and a secondary formed shell.

In accordance with one aspect of the disclosure, and with reference to FIG. 2, the main or base boom section 14 comprises an assembly, which includes a primary shell 18 and a secondary shell 20 connected to an external surface of the primary shell. As will be understood upon reviewing the description that follows, the use of an externally connected secondary shell 20 in this manner allows for the strategic strengthening of the overall boom assembly without unduly increasing its weight, as would be the case by simply adding thickness to the material forming the primary shell 18. Also, the technique used to manufacture the boom assembly 12 including the secondary shell 20 is more efficient than simply adding thickness to the primary shell in order to increase its strength.

Figure 3:
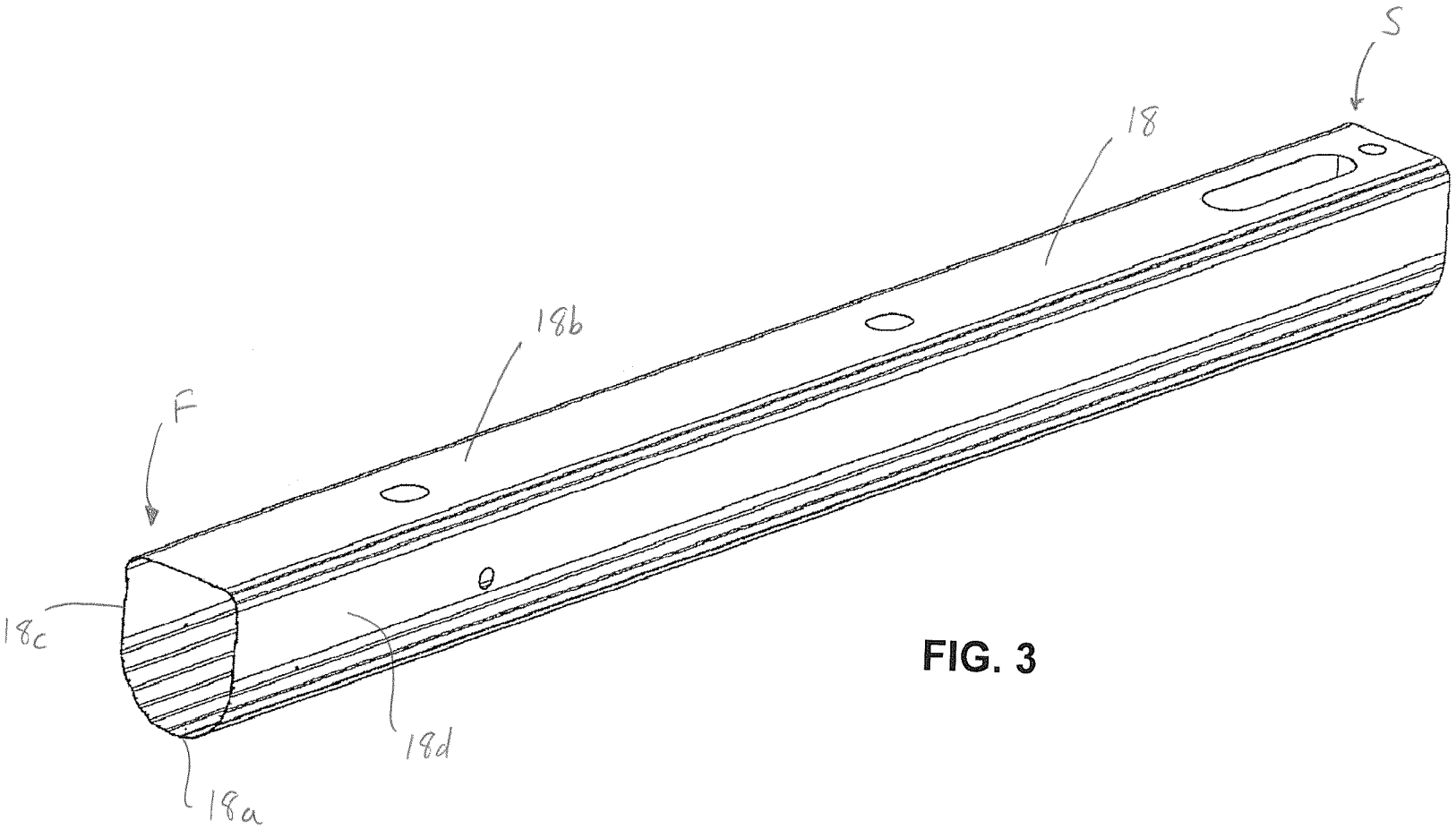
FIG. 3 is a perspective view of the primary shell.

With reference to FIG. 2 and also to FIG. 3, it can be understood that the primary shell 18 comprises an elongated tubular body (note longitudinal direction D) having a first end F adapted for receiving one or more telescoping sections, such as section 16 of FIG. 1. A second end S of the primary shell S is adapted for connecting with the base B, preferably in manner that allows pivoting in the vertical direction in response to actuation of the lifter L. The primary shell 18 comprises a bottom wall 18*a*, a top wall 18*b*, and generally parallel, opposing side walls 18*c*, 18*d*. Preferably, the bottom wall 18*a* is rounded, and is of a generally consistent thickness (e.g., less than about 10 millimeters and greater than about 5 millimeters) from the first end F to the second end S of the shell 18. Most preferably, the rounding is such that the bottom wall 18*a* of the primary shell 18 at the first end F provides seating surfaces for receiving wear shoes (not shown) which frictionally engage and help support the nested telescoping section 16 (as well as any other sections therein). A more complete description of such an arrangement may be found in Applicant's U.S. Pat. No. 6,499,612, the disclosure of which is incorporated herein by reference.

Figure 4:
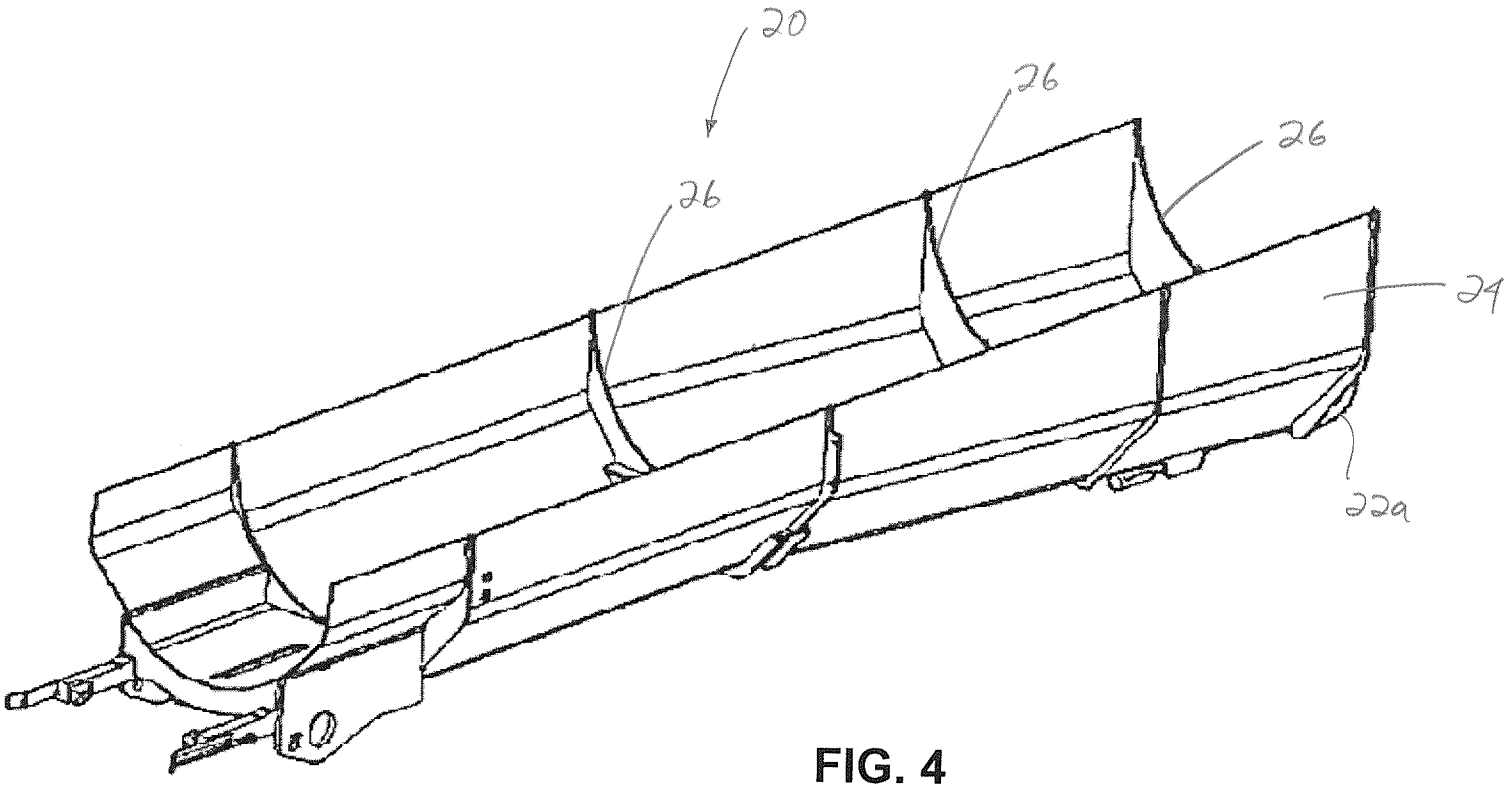
FIG. 4 is a perspective view of the secondary shell.

Turning to FIG. 4, an exemplary embodiment of the secondary shell 20 is shown. The secondary shell 20 is elongated in a direction corresponding to the longitudinal axis or dimension of the boom assembly 12. Preferably, the longitudinal dimension of the secondary shell 20 is such that, in the installed condition, it extends only from adjacent the first end F of the base boom section 14 to at least the connection point P for connecting with the lifter E. Most preferably, the secondary shell 20 when mounted in place extends fully from the first end F of the primary shell 18 and includes the connecting structure 22 for connecting with the lifter E to establish the corresponding connection point P for the boom assembly 12. In such case, the secondary shell 20 comprises less than 50% of the full longitudinal dimension of the primary shell 18, preferably between about 40% and about 50%, and most preferably closer to 42% thereof.

As can be understood, this secondary shell 20 is generally shaped to match the shape of the corresponding walls of the primary shell 18 it covers. Accordingly, in the preferred embodiment, the secondary shell 20 is generally U-shaped in cross-section, which corresponds to the rounded bottom wall 18*a* of the primary shell 18 covered by it (with the secondary shell 20 thus also considered to comprise the bottom wall of the base boom section 14 along the corresponding part of the boom assembly 12). Thus, when attached to the external surface of the primary shell 18, a gap G is formed with the inner surface of the secondary shell 20 (see FIGS. 7-8). With the exception of a few strengthening ribs, as noted below, the gap G is unoccupied by any material or filler. Hence, for purposes of this disclosure, the term "gap" refers to a space between two things that is unoccupied by any material that contributes to the strength or weight of the construction in a meaningful way.

Preferably, the arrangement is such that the gap G formed between at least the midpoint of the external surface of the bottom wall 18*a* of the primary shell 18 and the inner surface of the secondary shell 20 increases from a point adjacent to the first end F to the connection structure 22 corresponding to the connection point P for the lifter. Most preferably, the arrangement is such that the secondary shell 20 forms a first region $R_1$ adjacent the first end F of the primary shell 18 in which the gap $G_1$ is generally of a consistent vertical dimension, a second, similar region $R_2$ in which the gap $G_2$ may be equal to or greater than gap $G_1$, a third region $R_3$ in which the gap $G_3$ generally increases in the longitudinal direction from a point approximately equal to gap $G_2$, and a fourth region $R_4$ in which the gap $G_4$ is equal to or greater than gaps $G_2$ and $G_3$ and generally increasing in the longitudinal dimension. Stated another way, the base boom section 14 has a first height dimension (labeled height $H_1$) adjacent the first end F, and increases gradually to a second height dimension (labeled height $H_2$) larger than the first dimension adjacent to the connection point P, and a third height dimension (labeled height $H_3$) smaller than the first and second dimensions between the connection point P and the second end S (and, most preferably, the same constant dimension at all points therebetween), such that: $H_3<H_1<H_2$. The term "height dimension" for purposes of referencing the boom is a measurement taken in the vertical direction from one external surface of the boom base section 14 to the opposite one, and takes into account the dimension of structures that contribute to the lifting strength of the boom itself, but not any auxiliary structures, such as brackets, connectors, sheaves, or the like.

Consequently, the secondary shell 20 provides the primary shell 18 with a variable height. Preferably, the secondary shell 20 is considered to be at least partially tapered relative to the primary shell 18 in the longitudinal dimension D (in other words, the two structures move farther apart as the distance in this direction increases for at least a portion of their length). As the bending strength of a beam is exponentially related to its height, this tapering increases the strength of the primary shell 18 where it is most needed (adjacent the connection point P), since the forwardmost portion of the boom base section 14 is generally placed in high stress during loading by the telescoping of the nested section 16 or the lifting of loads.

To provide this differential gap $G_1$-$G_4$, the regions $R_1$-$R_4$ of the secondary shell 20 may be formed as individual unitary structures formed by bending a single piece of material, or of individual assemblies of generally flat plates 24 that are interconnected to form the generally U-shaped cross-sectional profile. In the latter case, these plates 24 may be welded to each other to form the individual weldment corresponding to any of the regions $R_1$-$R_4$. Most preferably, the two middle regions $R_2$-$R_3$ comprise unitarily formed structures, whereas the front and rear regions $R_1$, $R_4$ comprise a plurality of individual plates welded together. The materials used to form the secondary shell 20 may generally have a thickness similar to that of the wall thickness of the primary shell (e.g., approximately 5 millimeters).

Figure 5:
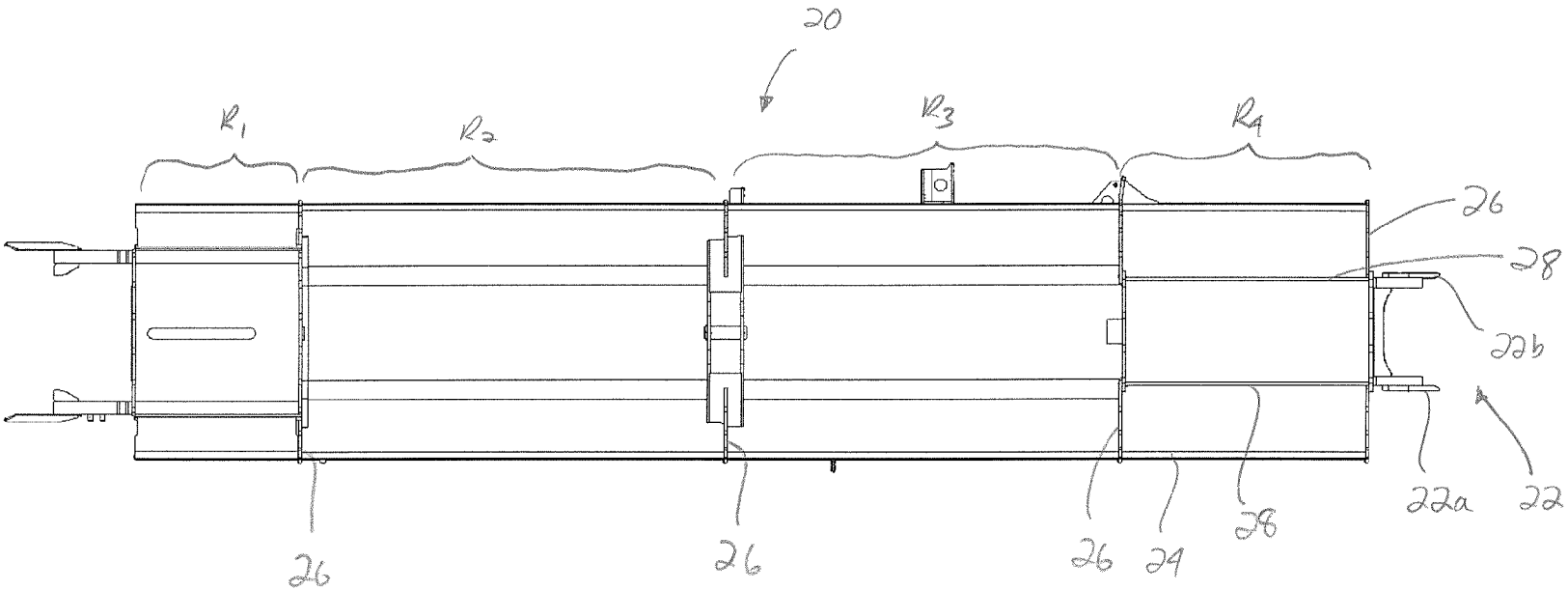
FIG. 5 is a top view of the secondary shell.

To help transmit loading between the primary shell 18 and the secondary shell 20, transverse interconnecting structures, such as ribs 26, may also be provided. As perhaps best understood with combined reference to FIGS. 4 and 5, these ribs 26 may be welded in place between the shells 18, 20, and may be contoured to match the corresponding surfaces. The portion of the secondary shell 20 associated with the first region $R_1$ may optionally be modified to receive the ends of optional anti-rotation structures A (see FIG. 2) projecting from the first end of the primary shell 18 for associating with a fly section when extended from the boom base section 14.

As noted above, the secondary shell 20 preferably includes the connection structure 22 for forming the connection with the corresponding end of the lifter E. Preferably, the connection structure 22 comprises a pair of spaced receivers 22*a*, 22*b* adapted for forming the connection with the lifter E in the necessary manner. These receivers 22*a*, 22*b* may be connected to the secondary shell 20 by ribs 28 (see FIGS. 5, 7, and 8), which extend in the longitudinal direction D at least partially through the portion of the secondary shell 20 corresponding to the fourth region $R_4$, and may also connect to the external surface of the primary shell 18.

Figure 6:
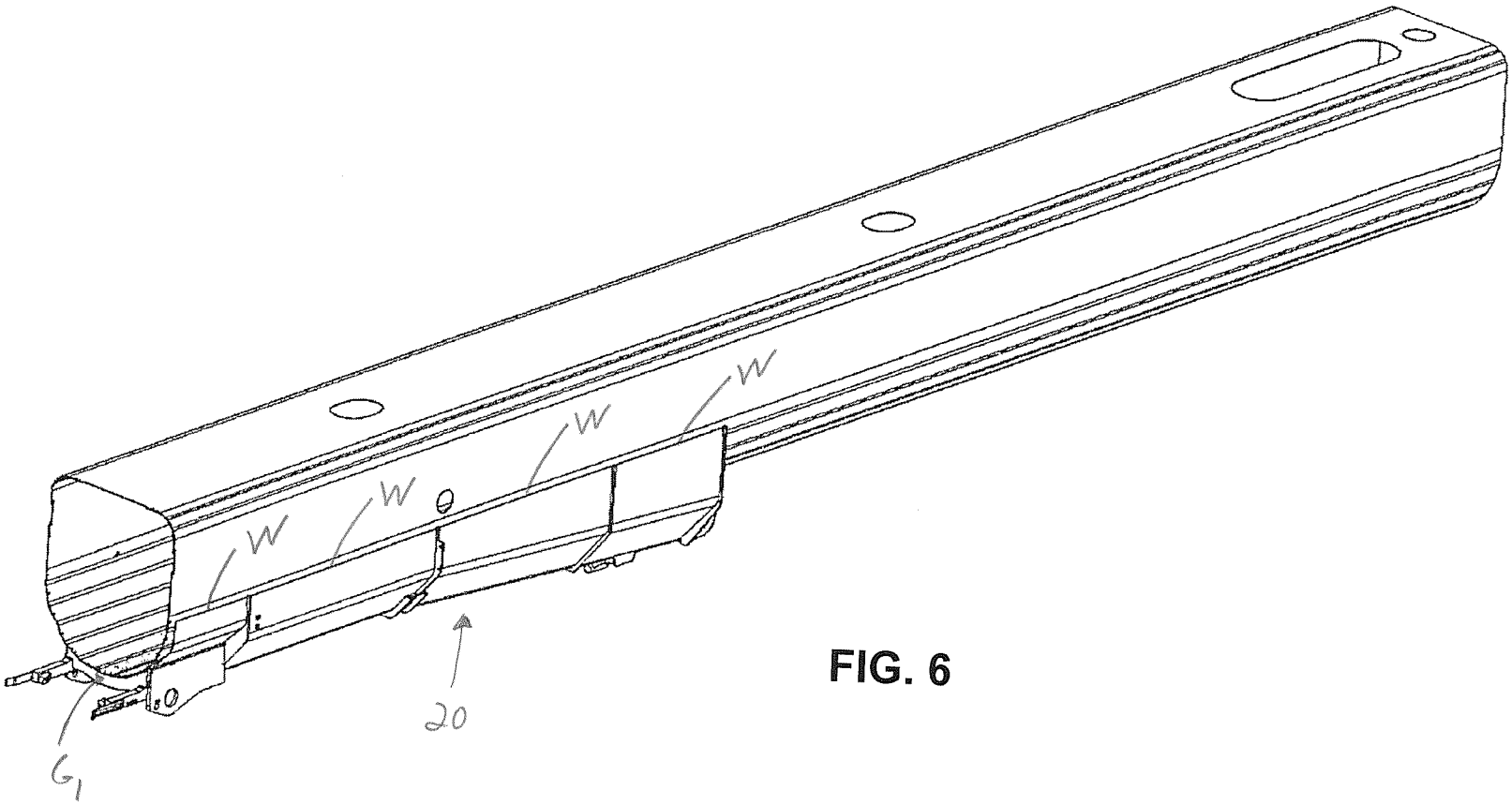
FIG. 6 is a perspective view of the boom base section including the primary and secondary shells.
Figure 7:
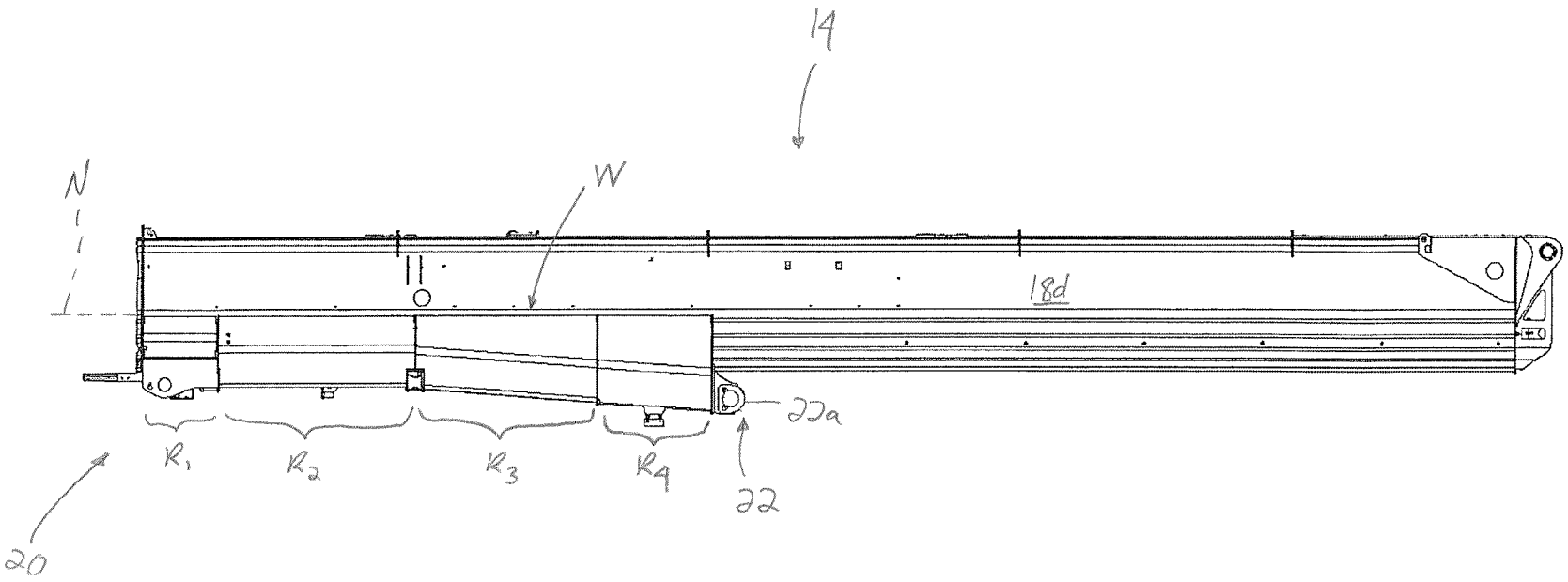
FIG. 7 is a side view of the boom base section.
Figure 8:
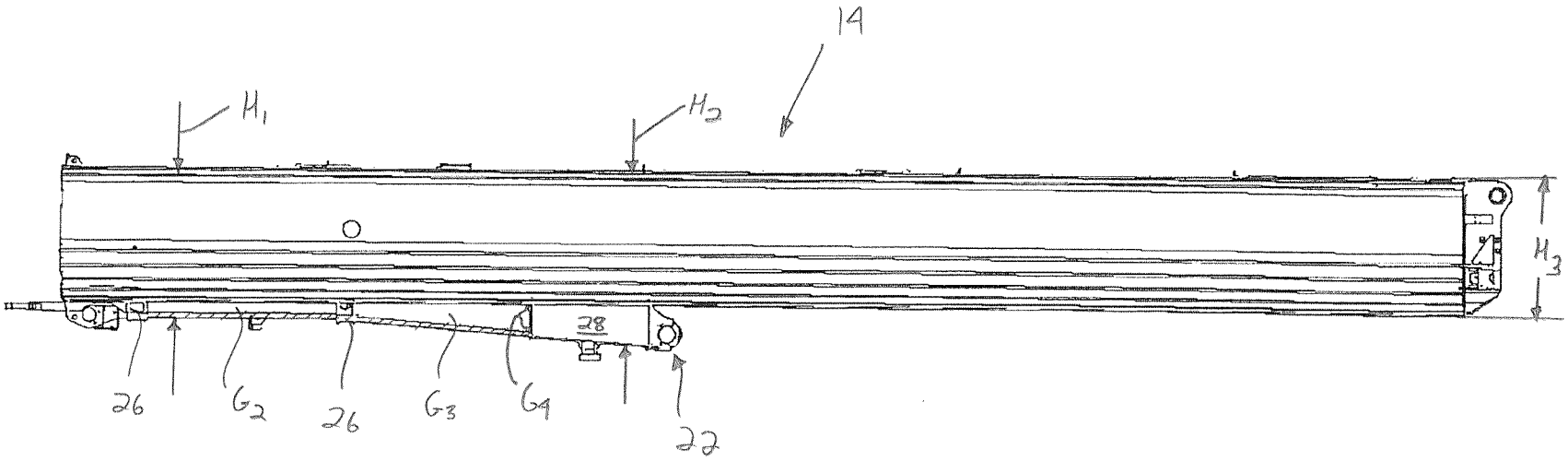
FIG. 8 is a view similar to FIG. 7, but with a partial cross-section of the secondary shell only.

Having now described the secondary shell 20 in detail, its manner of connection is now provided with reference to FIGS. 6-8. The secondary shell 20 is welded along its outer side edges to the primary shell 18. Preferably, the secondary shell 20 is arranged such that the inner surface of the uppermost side portions extends generally parallel to the corresponding outer surface of the sidewall 18*c* or 18*d* of the primary shell 18, and may thus be fixed in this position by one or more elongated welds W extending along the outer surfaces of the sidewalls in the longitudinal direction D. Most preferably, the arrangement is such that the uppermost side portions of the secondary shell 20 are aligned vertically with and generally parallel to the neutral axis N of the primary shell 18, with a horizontal plane through this axis generally intersecting the sidewalls 18*c*, 18*d* at the welds W. This arrangement avoids the complexity of welding along the rounded bottom wall of the primary shell 18, and also avoids the concomitant distortion created by welding a "doubler" directly in this region in an effort to increase boom strength.

As should be appreciated from the foregoing, a significant advantage of the secondary formed shell 20 is that it allows for the targeted strengthening of the base boom section 14 in the regions where it is most needed (that is, only between the connection point P and the first end F of the primary shell 18). Providing such focused strengthening allows for a corresponding reduction in the overall weight of the boom assembly 12, especially since a smaller or regular thickness of material may be used to form the primary shell 18 from adjacent the connection point P to adjacent the second end S. Besides reducing weight, this approach also eases the process of manufacturing the primary shell 18, since complicated techniques for forming a shell having a differential thickness along the bottom wall for added strength and corresponding complicated welding techniques (which normally require a welder to be positioned inside of the boom during assembly) may be avoided.

The foregoing description of certain embodiments provides the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A mobile crane for intended use in lifting an object, comprising:

chassis including a plurality of ground-engaging structures;

a lifter carried by the chassis for use in lifting the object; and a telescoping boom assembly carried by the chassis, said telescoping boom assembly including a base boom section extending in a longitudinal direction and at least one telescoping boom section nested at least partially within the base boom section, said base boom section including a primary shell including a bottom wall, a top wall, and sidewalls, said walls together defining a first end with an opening for receiving the at least one telescoping boom section, a second end opposite the first end, and an intermediate portion corresponding to a conation point for connecting the lifter to the telescoping boom assembly;

said base boom section further including a secondary shell connected to an external surface of the primary shell, said secondary shell is tapered in the longitudinal direction, extending from adjacent the connection point to adjacent the first end of the primary shell, and forming a gap between an inner surface of the secondary shell and the underlying external surface of at leas the bottom wall of the primary shell of the base boom section.

2. The crane according to claim 1, wherein the secondary shell is U-shaped in cross-section.

3. The crane according to claim 1, wherein the gap is greater adjacent the connection point than adjacent the first end of the base boom section.

4. The crane according to claim 1, wherein the secondary shell includes ribs extending between the outer surface of the primary shell and the inner surface of the secondary shell.

5. The crane according to claim 4, wherein the ribs extend in a direction transverse to the longitudinal direction.

6. The crane according to claim 4, wherein the ribs extend in the longitudinal direction.

7. The crane according to claim 6, wherein the ribs comprise plates welded to the bottom wall of the primary shell and the secondary shell.

8. The crane according to claim 1, further including welds for welding the secondary shell to the primary shell.

9. The crane according to claim 8, wherein at least a portion of the welds are provided between the secondary shell and at least one of the sidewalls of the primary shell.

10. The crane according to claim 8, wherein the primary shell includes a neutral axis, and the welds are positioned on opposing sides of the primary shell and in alignment with the neutral axis.

11. The crane according to claim 1, wherein the secondary shell includes the connector for connecting to the lifter to the telescoping boom assembly.

12. The crane according to claim 1, wherein a portion of the secondary shell has a thickness approximately equal to a thickness of a portion of the primary shell covered by the secondary shell.

13. A method for manufacturing a boom assembly arranged for lifting an object using a lifter, comprising:

providing a base boom section extending in a longitudinal direction and at least one telescoping boom section nested in the base boom section, said base boom section including a primary shell including a bottom wall, a top wall, and sidewalls, said walls together defining an opening for receiving the telescoping boom section, a second end opposite the first end, and an intermediate portion corresponding to a connection point for connecting the lifter; and welding a secondary shell at least partially tapered in the longitudinal direction to an external surface of the primary shell between the connection point and the first end, said shell forming a gap between the inner surface of the secondary shell and an outer surface of at least the bottom wall of the primary shell.

14. The method of claim 13, wherein the base boom section comprises a neutral axis, and wherein the welding step comprises welding the secondary shell to the base boom section using welds in the longitudinal direction in vertical alignment with the neutral axis.

15. The method according to claim 13, further including the step of providing the secondary shell with a connector for connecting the lifter to the secondary shell.

16. The crane according to claim 1, wherein the secondary shell is connected along an external surface of the bottom wall of the primary shell, and the gap is formed between the external surface of the bottom wall and an opposing inner surface of the secondary shell.

17. A mobile crane for intended use in lifting an object, comprising:

a chassis including a plurality of ground-engaging structures;

a lifter carried by the chassis for use in lifting the object; and a telescoping boom assembly carried by the chassis, said telescoping boom assembly including a base boom section extending in longitudinal direction and at least one telescoping boom section nested at least partially within the base boom section, section, said base boom section including a primary shell including a bottom wall, a top wall, and sidewalls, said walls together defining a first end with an opening for receiving the at least one telescoping boom section, a second end opposite the first end, and an intermediate portion corresponding to a connection point for connecting the lifter to the telescoping boom assembly;

said base boom section further including a secondary shell connected to an external surface of the primary shell, said secondary shell extending from adjacent the connection point to adjacent the first end of the primary shell, and forming a gap between an inner surface of the secondary shell and the underlying external surface of at least the bottom wall of the primary shell of the base boom section, wherein the gap is greater adjacent the connection point than adjacent the first end of the base boom section.

* * * * *

UNITED STATES PATENT AND TRADEMARK OFFICE

CERTIFICATE OF CORRECTION

PATENT NO. : 8,678,210 B1
APPLICATION NO. : 12/947946
DATED : March 25, 2014
INVENTOR(S) : Harrington et al.

It is certified that error appears in the above-identified patent and that said Letters Patent is hereby corrected as shown below:

In the Specification

Column 7, line 39, please insert an -- a -- before chassis.

Column 7, line 52, please replace “conation” with -- connection --.

Column 7, line 61, please replace “leas” with -- least --.

Column 8, line 65, please insert an -- a -- before longitudinal.

Column 8, line 67, please delete the second “section”.

Signed and Sealed this
Fourteenth Day of April, 2015

Michelle K. Lee

Michelle K. Lee
*Director of the United States Patent and Trademark Office*